US005884556A

United States Patent [19]

Klepacki et al.

[11] Patent Number: 5,884,556

[45] Date of Patent: Mar. 23, 1999

[54] TRASH HANDLING DEVICE

[75] Inventors: Frank H. Klepacki, Hinsdale, Ill.; David G. Klepacki, Colorado Springs, Colo.

[73] Assignee: Koncept Kreations, Ltd., Hinsdale, Ill.

[21] Appl. No.: 940,493

[22] Filed: Sep. 30, 1997

[51] Int. Cl.[6] ..... B30B 9/30; B30B 1/04

[52] U.S. Cl. ..... 100/53; 100/229 A; 100/233; 100/266; 100/281; 100/295; 220/908; 232/43.2

[58] Field of Search ..... 100/53, 229 A, 100/233, 240, 245, 246, 266, 281, 295; 220/908; 232/43.2, 43.3

[56] References Cited

U.S. PATENT DOCUMENTS

| | | | |
|---|---|---|---|
| 710,837 | 10/1902 | Bridger . | |
| 987,913 | 3/1911 | Reeves . | |
| 1,062,270 | 5/1913 | Burggaller . | |
| 1,068,854 | 7/1913 | Carden | 232/43.2 |
| 2,392,604 | 1/1946 | Mallory . | |
| 2,478,815 | 8/1949 | Forman . | |
| 2,665,632 | 1/1954 | Kawa . | |
| 2,968,235 | 1/1961 | Marica | 100/266 |
| 3,018,719 | 1/1962 | Watson | 100/266 |
| 3,285,505 | 11/1966 | Katz | 232/43.2 |
| 3,357,346 | 12/1967 | Crafoord | 100/229 A |
| 3,438,322 | 4/1969 | Marasco . | |
| 3,691,944 | 9/1972 | Boyd . | |
| 3,799,430 | 3/1974 | Huguenin | 232/43.2 |
| 3,838,635 | 10/1974 | Hardy . | |
| 3,841,214 | 10/1974 | Engebretsen . | |
| 3,901,139 | 8/1975 | Moriconi . | |
| 3,919,932 | 11/1975 | Basuino . | |
| 4,005,648 | 2/1977 | Edwards . | |
| 4,095,521 | 6/1978 | Hauptman | 100/229 A |
| 4,147,100 | 4/1979 | Dykstra . | |
| 4,152,979 | 5/1979 | Schmidt . | |
| 4,286,515 | 9/1981 | Baumann et al. . | |
| 4,424,740 | 1/1984 | Gwathney et al. . | |
| 4,519,308 | 5/1985 | Eberle . | |
| 4,552,061 | 11/1985 | Brutsman . | |
| 4,788,909 | 12/1988 | Stewart | 100/233 |
| 4,896,593 | 1/1990 | Slusser . | |
| 5,042,374 | 8/1991 | Klepacki . | |
| 5,348,222 | 9/1994 | Patey | 232/43.2 |
| 5,421,252 | 6/1995 | Reichel | 100/229 A |
| 5,440,978 | 8/1995 | O'Brien et al. | 100/229 A |
| 5,588,358 | 12/1996 | Klepacki et al. . | |

FOREIGN PATENT DOCUMENTS

| | | | |
|---|---|---|---|
| 725353 | 5/1932 | France . | |
| 2326725 | 12/1974 | Germany . | |
| 2703220 | 8/1978 | Germany . | |
| 2718145 | 11/1978 | Germany | 100/229 A |
| 2833632 | 2/1980 | Germany . | |
| 2912851 | 10/1980 | Germany . | |
| 4215970 | 11/1993 | Germany | 100/240 |
| 3-226399 | 10/1991 | Japan | 100/266 |
| 431373 | 8/1967 | Sweden | 100/266 |
| 677350 | 5/1991 | Sweden | 100/229 A |

*Primary Examiner*—Stephan F. Gerrity
*Attorney, Agent, or Firm*—Lloyd L. Zickert

[57] ABSTRACT

An improved trash handling device for receiving trash in a trash container enclosed within a housing where the housing has a completely enclosed manually operated trash compactor for selectively compacting the trash received in the container, wherein the compactor includes a pyramid-shaped compacting plate for engaging the trash in the container, a foot lever for rotating the compacting plate downwardly from resting position into the trash container, a pneumatic spring for biasing the compacting plate to resting position, and a safety lock preventing delivery of trash to the container during a compacting cycle.

14 Claims, 4 Drawing Sheets

TRASH HANDLING DEVICE

DESCRIPTION

This invention relates in general to an improved trash handling device including an outer housing, a trash container and a compactor for compacting the trash within the container, and more particularly to a trash handling device for use in fast-food restaurants where the patrons may deposit their trash through an outer housing and into a trash container and an employee of the restaurant operates a completely enclosed compactor for compacting that trash within the container to facilitate the handling of trash.

BACKGROUND OF THE INVENTION

It is well known that trash in fast-food restaurants is generally light in weight because it includes drinking cups, cardboard food containers, wrapping papers, and molded plastic food containers. When patrons of the restaurant eat within the restaurant, they normally deposit their trash into a trash receptacle which includes a housing within which a trash container is provided and a swinging door for access to the interior of the housing which allows the patrons to deposit trash through the swinging door into the trash container located within the housing. It is also known to provide plastic liners for the trash containers in the form of bags within which the trash is collected and thereafter removed from the trash containers when filled. Such trash handling units require the use of many plastic trash bags and labor intensive manpower to handle the bags and maintain the trash within the containers at a level that will allow them to receive further trash, so that the trash does not spill out onto the floor.

Considerable storage area is necessary in order to store filled trash bags accumulated during the servicing of a trash receptacle. A bag holding the trash in the container must be removed from the container, closed and tied off and replaced with another empty bag. Then the filled bag is removed to a disposal service area for storage until a garbage service removes the trash. Because of the rapid buildup of trash, manual handling of filled trash bags and a large storage area must be provided to accommodate the filled trash bags.

Heretofore, it has been well known to provide trash handling devices which include compactors for trash containers such as shown in U.S. Pat. No. 5,588,358 to minimize the number of bags. However, the potential problems with this trash handling device is that the lever or handle for operating the compactor is on the exterior of the trash receptacle and is thereby operable by a patron of the restaurant, which is undesirable. Further, the compacting plate may not be sufficiently sized and shaped to completely compact the trash in the plastic bag to fully maximize the amount of trash in the bag.

SUMMARY OF THE INVENTION

The present invention is in an improved trash handling device for receiving trash and compacting trash of the light-weight and "airy" type, such as produced in a fast-food restaurant, and which greatly facilitates the handling of trash, including the storage of trash prior to being picked up by a garbage collector. The trash would include paper and plastic cups, paper and plastic containers, paper wrapping materials, straws, napkins, together with perhaps a minor amount of garbage, all of which can be easily compacted in plastic bags, and thereafter transferred to a storage area.

The trash handling device of the present invention includes the well known housing presently used for trash handling wherein a trash container would be provided within the housing. The trash container may have a plastic liner or bag mounted within the container so that trash is deposited directly into the bag. The housing includes a swinging trash input or deposit door into which the trash can be delivered by a patron of the restaurant to fall by gravity into the trash container.

More particularly, the trash handling device of the present invention includes a housing very much like those used in trash receptacles presently used in fast-food restaurants. The housing is a box-like structure having opposed side walls, a rear wall, a bottom wall, a top wall, and a front wall being made up of a front door openable to facilitate removing and replacing the trash container, and a swinging trash input door or panel that a patron would operate to deliver trash to the trash container within the housing. The interior of the housing of the present invention includes a compactor having a manually operable foot lever mounted along one of the side walls for actuating a compacting plate. The compacting plate is pyramid-shaped and is carried on a shaft that is pivotally mounted in the side walls of the housing and operated by the foot lever. The compactor is thereby operated by an employee of the restaurant by opening the front door and stepping on the foot lever in the interior of the housing to drive the pyramid-shaped compacting plate from resting position downwardly into the container to compact the trash. The pyramidal shaped compactor plate drives the trash downwardly and to the front, back and sides of the container. The compactor further includes at least one pneumatic spring for biasing the compacting plate back in to resting position.

The device of the present invention includes a safety lock apparatus for preventing the opening of the swinging trash input door when the compactor is in a compacting cycle. The safety lock mechanism is automatically operated once the compacting plate is swung from its rest position and into its compacting cycle.

It is therefore an object of the present invention to provide a new and improved trash handling device for use in minimizing trash buildup by providing a manually operated compactor which compacts the trash within a plastic bag received in a trash container.

Another object of the present invention is to provide a trash handling device having a foot lever operated compactor which is fully enclosed by the housing and which cannot be operated by a patron of the restaurant.

A further object of the present invention is to provide a trash handling device having a pyramid-shaped compacting plate or plunger.

Another object of the present invention is to provide a trash handling device having a compactor wherein delivery of trash into the trash container is precluded during a compacting cycle, thereby preventing a patron or employee of the restaurant from reaching into the housing through the trash input door during compacting of the trash in the container.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
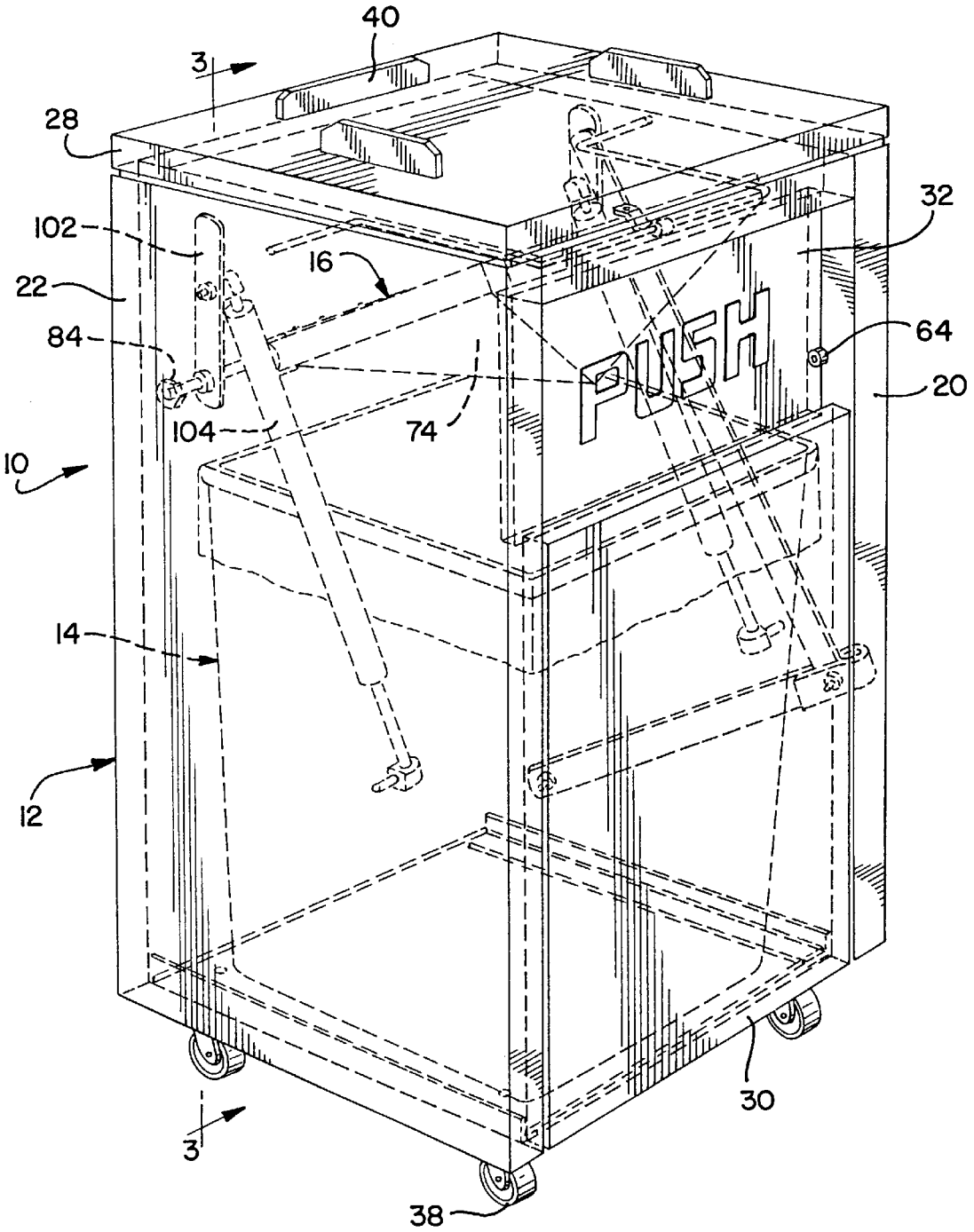
FIG. 1 is a perspective view of the trash handling device of the present invention showing parts within the housing in phantom and illustrating the pyramid-shaped compacting plate in rest position.

Referring now to the drawings, and particularly to FIGS. 1 to 4, the trash handling device of the present invention, generally indicated by the numeral 10, includes a housing 12 in which a trash container 14 is received for collecting trash such as would be produced in a fast-food restaurant. As already mentioned, this trash would include crushable cups of plastic or paper, crushable boxes, crushable cartons, paper wrappers, straws, and other packaging materials for food as normally used in fast-food restaurants. Compacting the trash within a bag received by the trash container 14 is accomplished by a compactor 16 that also functions to control the locking mechanism 18 which assures that the trash input door which is opened to deliver trash to the container remains in closed position during the compacting cycles.

Figure 4:
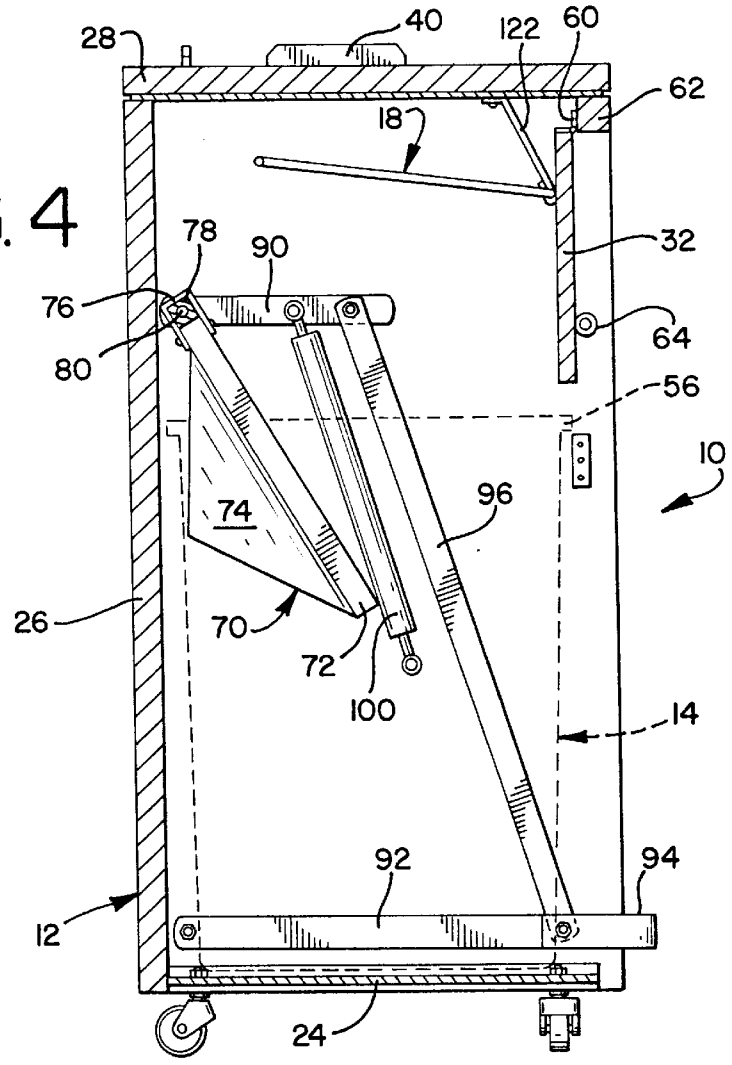
FIG. 4 is a side elevational view of the trash handling device illustrating the pyramid-shaped compacting plate swung into the container and showing the locking mechanism in lock position so that the swinging trash input door cannot be opened to deliver trash into the trash container, and illustrating in phantom the trash container.
Figure 3:
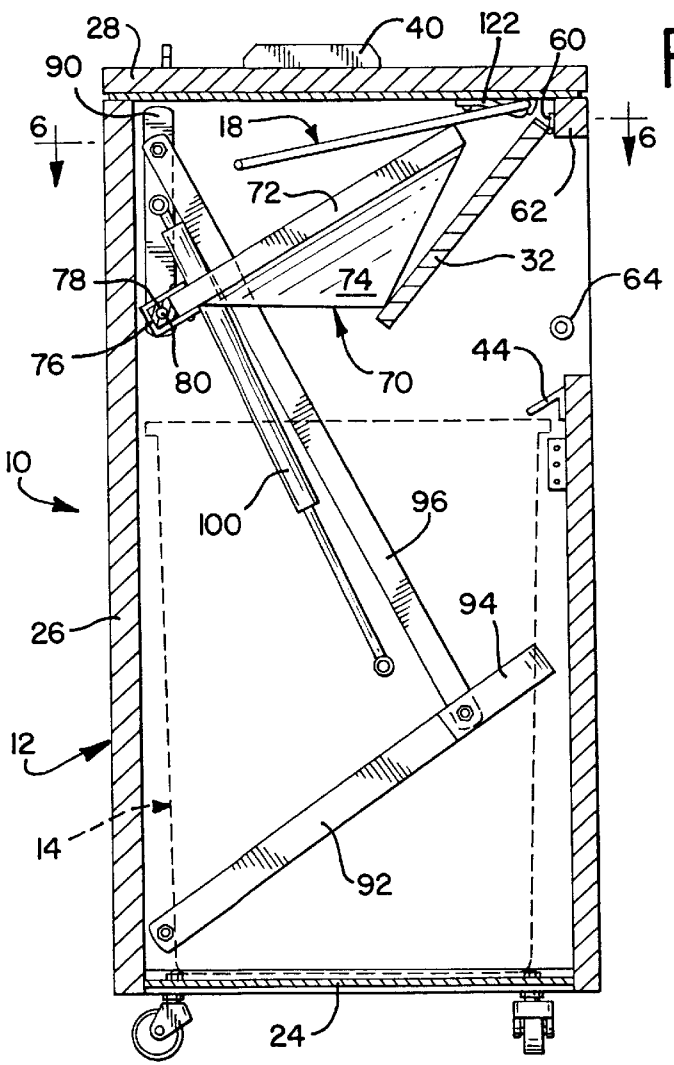
FIG. 3 is a side elevational view of the trash handling device of FIG. 1 taken substantially along line 3—3 of FIG. 1 and showing the pyramid-shaped compacting plate in rest position and the trash input door in open position, and illustrating in phantom the trash container.
Figure 5:
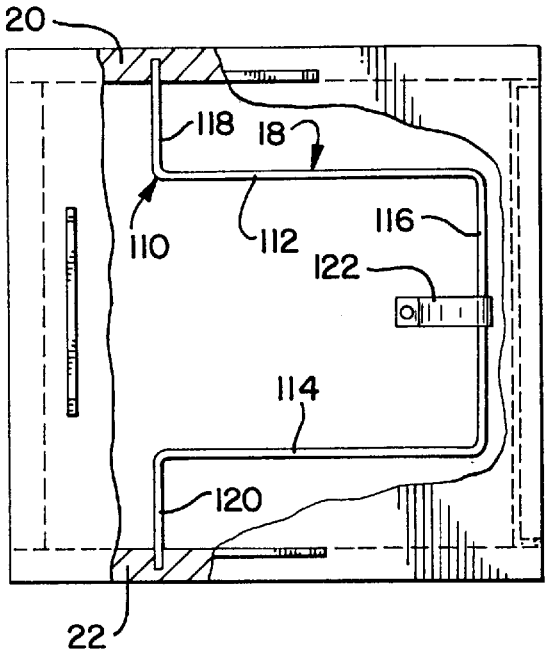
FIG. 5 is a top plan view of the trash handling device with a part of the housing broken away to illustrate the locking mechanism for locking the trash input door in closed position during the compacting cycle.

The housing 12 is an upstanding generally rectangular shaped housing which includes opposed side walls 20 and 22, a bottom wall 24, a back or rear wall 26, a top wall 28, a front access door 30 that allows opening of the housing for servicing the trash container 14, and a swinging trash input or delivery door 32 that is pushed open by a patron delivering trash to the trash container. As seen in FIGS. 1, 3, and 4, the trash container 14 fits within the housing and is supported on the bottom wall or floor 24 of the housing. Angle iron supports 34 and 36 are mounted on the inside surface of the side walls 20 and 22 at the lower edges thereof and on which the bottom wall 24 is supported. Further, a plurality of casters 38 are suitably mounted at the bottom of the housing to the angle iron supports 34 and 36 to facilitate the mobility of the entire trash handling device 10 so that it can roll along the floor and be easily moved between different positions as desired.

The upper side of the top wall 28 includes three guide members 40 for the purpose of enhancing the stackability of trays placed on the top wall by the patrons after disposing of the trash on those trays.

Figure 2:
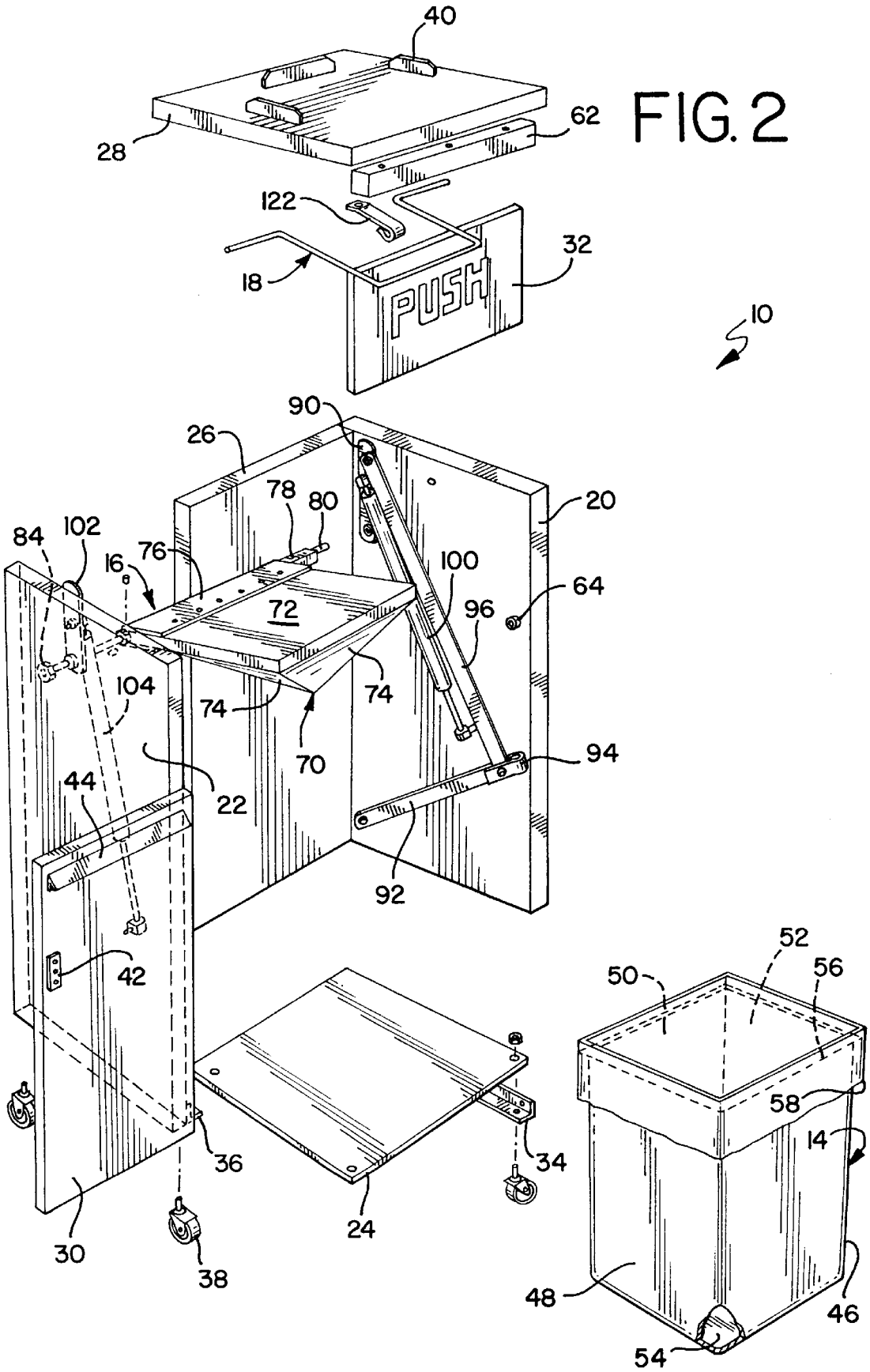
FIG. 2 is an exploded perspective view of the trash handling device of FIG. 1.

The front access door 30 is suitably hinged to the side wall 22 at one side and provided with a suitable latch mechanism for maintaining the door in closed position once the trash container has been placed within the housing and on the floor of the housing. While any suitable type of latch mechanism may be used, it may be of the well known magnetic type. A keeper plate 42 for such a magnetic latch is shown in FIG. 2.

A guide member 44 is mounted on the inside of the front access door 30 along the top edge to provide a guide for trash to go directly into the trash container after it has been delivered through the trash input door 32 and prevent trash from falling between the container 14 and door 30. The disposition of this guide member 44 is illustrated particularly in FIG. 3, where it is seen that it overlies the top of the container 14 when the door 30 is in closed position.

The trash container 14 is of a standard plastic molded type and includes four upstanding walls 46, 48, 50, and 52 extending from a bottom wall 54. A formed reenforcing edge 56 is disposed at the upper ends of the side walls which not only reenforces the container but also provides a ledge to grasp the container for moving it in and out of the housing. The container is sized as shown in phantom in FIGS. 3 and 4 to extend upwardly so that the reenforcing edge 56 is disposed just below the guide member 44 when the front access door 30 is closed, as seen in FIG. 3. A plastic bag 58 is received by the container and sized so that the upper end of the plastic bag can be folded over the outer side of the upper part of the container as shown in FIG. 2.

The trash input or delivery door 32 is rectangular in shape and hingedly mounted by a hinge 60 to a hinge bar 62 that is secured to the front underside edge of the top wall 28. A stop 64 is mounted on the inside of the side wall 20 to prevent the trash input door 32 from swinging outwardly and thereby only allowing it to swing inwardly, as illustrated in FIG. 3. While it is not necessary to spring-bias the door to the closed position, as shown in FIG. 4, as the door will gravitationally swing to the closed position when not being forced to swing inwardly, it could be appreciated that a spring hinge could be provided if desired. It will also be appreciated that the trash input door 32 is dimensioned to facilitate a person to push it open either by means of a tray or by their hands very easily and defines an opening in the housing that facilitates the delivery of trash into the housing and into the trash container.

Referring now to FIGS. 1 through 6, the compactor 16 includes an upside-down pyramid-shaped compacting plate or plunger 70 sized to fit within the upper open end of the trash container when swung downwardly, as shown in FIG. 4. The compacting plate 70 may be made of metal or plastic having sufficient strength to assure repeated compacting cycles without deformation of the plate. More specifically, the compacting plate 70 includes a head plate 72 and four downwardly converging compacting walls 74 which form the upside-down pyramid shape of the compacting plate 70. This shape forces the trash downwardly into the container as well as toward the front, back and side walls of the container. The rear edge of the head plate 72 is mounted in a U-shaped channel bracket 76 by suitable fastening means. A substantially square tubular sleeve 78 is securely mounted in the channel bracket 76 on an axle or shaft 80 and between the rear edge of the head plate 72 and the bight portion of the U-shaped channel bracket 76. Suitable roll pins or keys (not shown) may be provided to lock the tubular sleeve 78 on the shaft 80 so that the compacting plate 70 turns with the rotating of the shaft 80.

The opposite ends of the shaft 80 are mounted in bearings 82 and 84 (FIG. 6) carried by the opposed side walls 20 and 22 of the housing 12. The shaft 80 does not protrude outwardly from the side walls 20 and 22, and the entire compactor assembly 16 is thereby completely and fully enclosed in the housing 12 which prevents operation by a patron of the restaurant. The compactor 16 further includes a pivot arm 90 fixedly connected to the axle or shaft 80 on the side of the compacting plate 70 adjacent to wall 20 of the housing, which in resting position is disposed in a substantially vertical position, as illustrated in FIG. 3. Further, the compactor 16 includes a foot lever 92 pivotally connected at one end near the rear bottom portion of the same wall 20 of the housing and includes a foot pedal 94 mounted at the end opposite the pivotal mounting to the side wall 20. A linkage bar 96 pivotally attached at one end to an intermediate point along the pivot arm 90, and to the foot lever 92 at the other end connects the pivot arm 90 and the foot lever 92 such that activation of the foot lever 92 (i.e., by applying downward pressure to the foot pedal 94) will cause the pivot arm 90 to rotate downwardly, thereby causing activation (i.e., downward rotation) of the compacting plate 70, as illustrated in FIG. 4. The compacting plate 70 thereby enters the container 14 and the four compacting walls 74 push any trash therein downwardly into and to the sides of the container.

Figure 6:
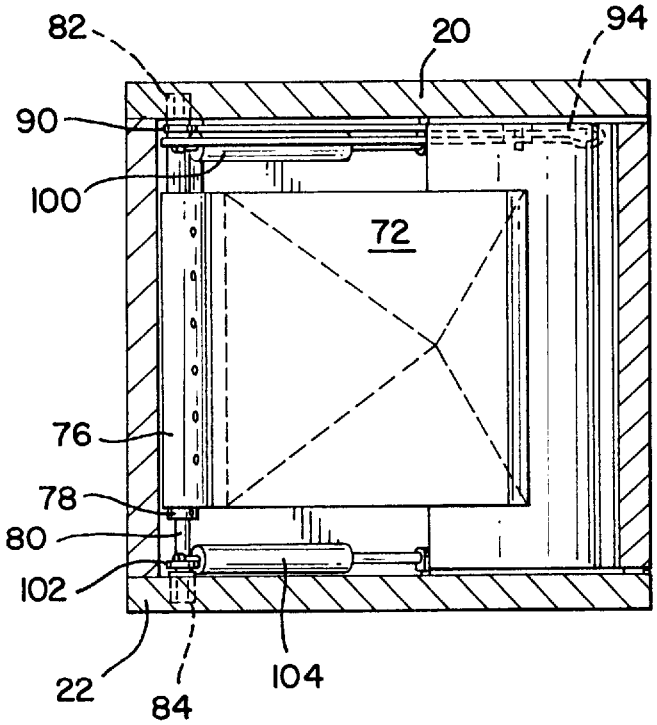
FIG. 6 is a transverse sectional view taken substantially along the lines 6—6 of FIG. 3.

A pneumatic spring 100 is pivotally attached at one end to the pivot arm 90 and at the other end to the side wall 20 of the housing to normally bias the compacting plate 70 into its resting or up position removed from the path of the swinging door 32, as shown in FIG. 3. As illustrated in FIGS. 1, 2, and 6, a second pivot arm 102 may be fixedly attached to the opposite side of the shaft 80 and a second pneumatic spring 104 may be pivotally attached at one end to the pivot arm 102 and at the other end to the side wall 22 of the housing to coact with the pneumatic spring 100 to normally bias the compacting plate 70 into its resting position.

In order to prevent a person from opening the trash door 32 during a compacting cycle, the safety locking mechanism 18 automatically pivotally drops into locking position upon the initiation of a compacting cycle so that until the compacting plate is back in the position illustrated in FIG. 3, the swinging trash door 32 cannot be opened. As further illustrated in FIG. 5, the safety lock mechanism 18 includes a generally U-shaped wire locking member 110 having spaced apart extension rods 1 12 and 1 14 connected by a connecting rod 1 1 6 and having pivot rods 118 and 120 which extend outwardly from the extension rods 112 and 114 and are freely received in holes formed in the side walls 20 and 22 of the housing that merely serve as bearing members for the wire locking member 110. Further, a flexible member or strap 122 which is attached at one end to the bottom surface of the top wall 28 and at the other end to the connecting rod 116 is provided for limiting the downward movement of the wire locking member 110, as illustrated in FIG. 4. When the compacting plate 70 is in trash engaging position as shown in FIG. 4, the wire locking member 110 will gravitationally swing or pivot downwardly to the locking position whereby the connecting rod 116 sits behind the trash input door 22 and prevents it from being swung open, thereby locking the door in closed position. The compacting plate 70 and specifically the head plate 72 serve to drive the wire locking member 110 into unlocked position when the compacting plate 70 moves upwardly to its resting position, as shown in FIG. 3.

In operation, it will be appreciated that the trash container will be provided in the housing with a plastic bag inserted therein to prepare the trash handling device for receiving trash. Persons will be delivering trash to the container through the trash access or delivery door 32. When the trash reaches a level sufficient that it can be compacted, an operator an employee of the restaurant will need to unlock and open the front door 30 to use his foot to engage the foot pedal 94 and push it downwardly to rotate the trash compacting plate 70 into the trash container and effect a compacting cycle, as shown in FIG. 4. When the compacting plate is rotated so that the locking bar 110 drops into locking position against the trash access door 32, it will be appreciated that the door cannot be opened. While the wire locking member 110 is gravitationally operated into locked position upon being released by the compacting plate, it will be appreciated that a spring means may be provided at the pivot area of the locking wire in order to normally bias the locking wire into locked position if desired.

Accordingly, the present invention provides a unique improved trash handling device with a fully enclosed compactor that can be used to advantage in a fast-food restaurant for compacting trash and minimizing the trash buildup that is normally experienced when the trash is not compacted and reduce the number of trash bags and space needed for their storage. Further, the compactor is built into the trash handling device and fully enclosed in such a way that it can easily be operated by an employee of the restaurant, but not accessible to a patron of the restaurant.

It will be understood that modifications and variations may be effected without departing from the scope of the novel concepts of the present invention, but it is understood that this application is to be limited only by the scope of the appended claims.

The invention is hereby claimed as follows:

1. A trash handling device comprising a housing within which a trash container is received, said container having an open upper end, said housing including an access door swingable inwardly to allow trash to be delivered to said container, a compactor including a pyramid-shaped compacting plate pivotally mounted within the housing and swingable into said container to compact trash therein, foot lever means interior of the housing connected to said pyramid-shaped compacting plate for selectively driving the plate into said container and compacting trash therein, and means normally biasing said pyramid-shaped compacting plate to a rest position above said container and permitting said access door to freely swing inward for depositing trash in said container.

2. The trash handling device of claim 1, which further includes safety lock means pivotally connected to said housing and for preventing said access door from swinging inwardly when said pyramid-shaped compacting plate is moved from the rest position to prevent a person from being injured during a compacting cycle.

3. The device of claim 2, wherein said safety lock means includes a locking member pivotally mounted to the housing and gravitationally biased into a position blocking the access door from swinging inwardly and automatically driven out of blocking position by said compacting plate when the plate goes to said rest position.

4. The device of claim 3, wherein the blocking member is a U-shaped wire.

5. The device of claim 1, wherein said housing further includes a door which must be opened to access the foot lever and to empty the trash container.

6. The device of claim 1, wherein the housing further includes top and bottom walls, opposed upstanding side walls, an upstanding rear wall, a front door opposite said back wall, and said swingable access door being disposed above said front door.

7. The device of claim 6, wherein said trash container is supported on said bottom wall, and said compacting plate is pivotally mounted to the side walls.

8. A trash handling device comprising:

a housing having a trash input door and a container access door, a trash container removably received in said housing through said container access door, a manually operated compactor mounted in and completely enclosed within said housing and accessible through said container access door, whereby the container access door must be opened to manually operate and cause the compactor to compact trash in the trash container.

9. The trash handling device of claim 8, wherein the compactor includes a pyramid-shaped compacting plate.

10. The trash handling device of claim 8, wherein the compactor includes a compacting plate and a foot-actuated lever attached to the compacting plate, whereby applying foot pressure to the lever drives the compacting plate from a resting position into the trash container.

11. The trash handling device of claim 10, wherein the compactor includes at least one pneumatic spring means for biasing the compacting plate out of the trash container and into resting position.

12. The trash handling device of claim 8, which further includes a locking mechanism attached to and completely enclosed in the housing and adapted to prevent the trash input door from opening when the compactor is compacting trash in the trash container.

13. The trash handling device of claim 12, wherein the locking mechanism includes a substantially U-shaped locking wire pivotally connected to opposed side walls in the housing.

14. The trash handling device of claim 13, wherein the locking mechanism further includes a flexible strap secured to the housing at one end and the wire member at the opposite end which limits the movement of the locking wire.

* * * * *